US005190336A

United States Patent [19]

Palz

[11] Patent Number: 5,190,336

[45] Date of Patent: Mar. 2, 1993

[54] POCKET CARRIER FOR SKIS AND POLES

[76] Inventor: George R. Palz, 46 Wells Ave., Cheektowaga, N.Y. 14227

[21] Appl. No.: 805,854

[22] Filed: Dec. 10, 1991

[51] Int. Cl.[5] ..... A63C 11/02

[52] U.S. Cl. ..... 294/147; 280/814; 294/149

[58] Field of Search ..... 294/141, 147–150, 294/157, 162, 163, 165; 24/115 G, 115 H, 136 R; 211/70.5; 224/917; 280/814

[56] References Cited

U.S. PATENT DOCUMENTS

| | | | |
|---|---|---|---|
| 3,257,054 | 6/1966 | Miesel | 294/149 |
| 3,342,388 | 9/1967 | Duckworth | 294/147 X |
| 3,486,672 | 12/1969 | Esopi | 294/147 X |
| 3,554,417 | 1/1971 | Yorty | 294/149 |
| 3,768,711 | 10/1973 | Wilkinson | 294/147 X |
| 3,841,542 | 10/1974 | Hogensen | 294/141 X |
| 3,947,927 | 4/1976 | Rosenthal | 294/147 X |
| 4,328,605 | 5/1982 | Hutchison et al. | 24/115 G |
| 4,588,115 | 5/1986 | Uyeda | 294/147 X |
| 4,729,591 | 3/1988 | Scalise | 294/147 X |
| 4,968,060 | 11/1990 | Rooney | 280/814 |

FOREIGN PATENT DOCUMENTS

| | | | |
|---|---|---|---|
| 2469190 | 5/1981 | France | 294/147 |
| 7906337 | 2/1981 | Netherlands | 294/147 |

*Primary Examiner*—Johnny D. Cherry

*Attorney, Agent, or Firm*—Hodgson, Russ, Andrews, Woods & Goodyear

[57] ABSTRACT

A carrier for skis and poles which uses the poles as the handles while hand carrying them in either a horizontal position or a vertical position with one's hand and shoulder between the poles and the skis. The carrier can also be used to hang both the poles and skis for storage when they are not being used. The carrier consists of two identical parts both of which are made with flexible nylon cord, two cord locks and a rubber/plastic coating. The cord on each forms two loops. One of the loops is tightened with a lock against the skis and the other loop is tightened against the poles. One assembly will attach to the upper part of the skis and poles, while the other will attach to the bottom of the skis and poles.

6 Claims, 1 Drawing Sheet

POCKET CARRIER FOR SKIS AND POLES

BACKGROUND OF THE INVENTION

This invention relates to the art of carriers for skis and poles, and more particularly to a new and improved hand carrier for skis and poles which may be carried in the user's pocket while skiing.

Skiers must carry their skis and poles to and from cars or busses, to lodges or homes, and to ski lifts. Skis and poles are very cumbersome to hand carry because the skis are about as long as the skier is tall and have sharp edges. The poles are about half as long with sharp points. Traditionally, these were carried over the shoulder or under the arm in an awkward fashion. Furthermore, if several pairs of skis were stored together, the poles and skis of the different pairs would get stuck together or mixed-up.

There are several products presently on the market that try to reduce some of these problems, but they are either so bulky and rigid that they take up a lot of space and have to be locked up while not in use, for fear of being stolen, or do not solve all of the inconveniences mentioned.

It would, therefore, be highly desirable to provide a hand carrier for skis and poles, which may also be used as a hanger for storage and which may be carried in the user's pocket while skiing, thereby providing a real convenience to the skier.

SUMMARY OF THE INVENTION

The present invention provides a hand carrier for skis and poles comprising a strong but flexible cord which is formed into two loops separated by two cord locks. One lock tightens one of the loops against the skis and the other cord lock tightens the other loop against the poles. These assemblies are used in pairs. One slips over the tops of both skis and poles, while the other slips over the bottom of the skis and poles. The pair of carriers are small and flexible enough to be carried in the skier's pocket while skiing. The skier may carry the skis and poles in a horizontal position along side using the poles as handles like a suitcase or in a vertical position over the shoulder with the arm placed between the poles and the skis. There is a space between the skis and the poles sufficient to allow them to be hung over a peg or hook together when not in use, ready for the next outing.

The foregoing and additional advantages and characterizing features of the present invention will become clearly apparent from a reading of the ensuing detailed description together with the included drawing wherein:

BRIEF DESCRIPTION OF THE DRAWING FIGURES

DETAILED DESCRIPTION OF THE ILLUSTRATED EMBODIMENT

Figure 1:
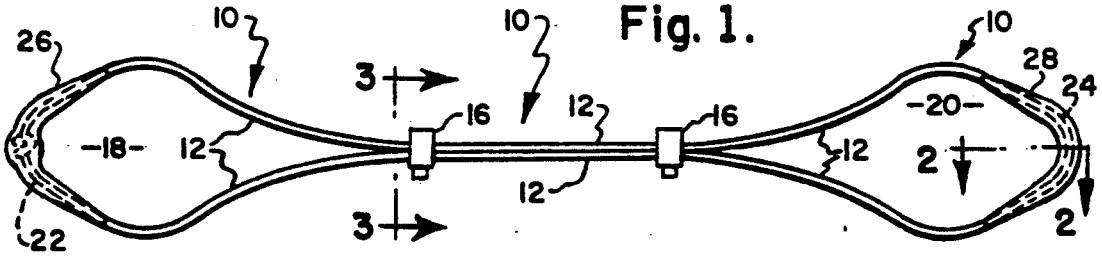
FIG. 1 is an elevational view of the hand carrier for skis and poles according to the present invention.
Figure 2:
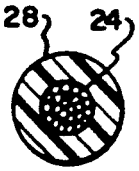
FIG. 2 is an enlarged sectional view taken about on line 2—2 in FIG. 1.

FIG. 1 shows the carrier 10 according to the present invention comprising a flexible nylon cord 12 which has the ends fastened together to form a continuous length of cord with a circumferential length of about 24 inches. This cord 12 then is put through a pair of identical cord locks, each designated 16, which form two loops 18 and 20, one on each end of both pieces of cord. The ends 22,24 of the loops farthest from the cord locks are provided with corresponding coverings 26,28 of rubber/-plastic material. Typically, a pair of carriers, each identical to carrier 10 of FIG. 1, is provided for use in carrying poles and skis in a manner which will be described.

Figure 3:
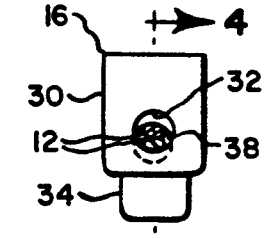
FIG. 3 is an enlarged fragmentary elevational view taken about on line 3—3 in FIG. 1.
Figure 4:
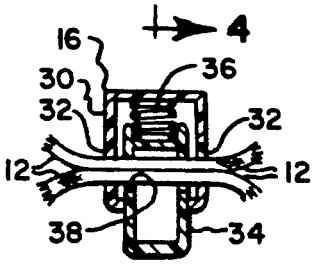
FIG. 4 is a sectional view taken about on line 4—4 in FIG. 3.

A preferred form of cord lock 16 is shown in detail in FIGS. 3 and 4 and includes, briefly, a cylindrical housing 30 provided with laterally aligned cord receiving openings 32 in the wall thereof, a button 34 received in housing 30 and movable against the force of a biasing spring 36 within housing 30 provided with aligned cord receiving openings 38 which register with openings 32. When the top of button 34 of the lock 16 is pushed in, it disengages, allowing the cord 12 to slip through and opens or closes the loops 18,20 which hold the poles or skis, depending upon the direction of movement of cord 12 relative to lock 16. When the button 34 of the lock 16 is released, the lock holds the cord 12 tightly, thereby securing the poles and skis tightly against the rubber/-plastic part of the loop. Lock 16 shown in FIGS. 1, 3 and 4 is the type commercially available from Plas-Tech of Denver, Colo. and described in U.S. Pat. No. 4,328,605, the disclosure of which is hereby incorporated by reference.

Figure 5:
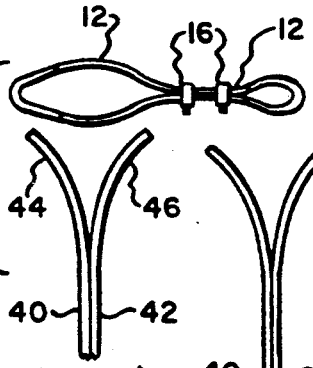
FIGS. 5, 6 and 7 are fragmentary elevational views illustrating the manner in which the carrier of the present invention is attached to skis and poles.
Figure 6:
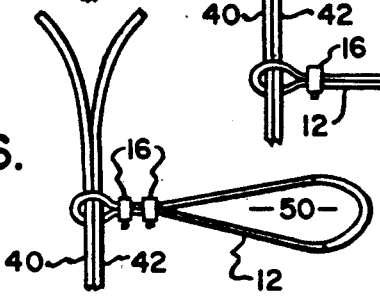
Figure 7:
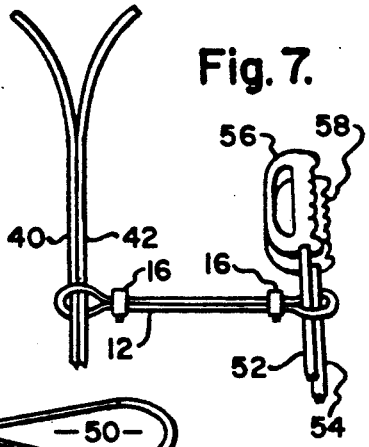

To attach each of the carriers 10, the skis 40,42 must first be placed bottom to bottom, on top of each other. One of the carrier assemblies 10 should be placed over the curved front parts 44,46 of the skis 40 and 42, respectively, as shown in FIG. 5. To do this, both cord locks 16 must be depressed and pushed along the cord 12, until they are stopped by the corresponding rubber/plastic coating 26 or 28. Then the large loop which is created by this movement should be placed over the front part of the skis as shown in FIG. 5. Now, both of the cord locks 16 should be depressed and moved tight against the skis 40,42 as shown in FIG. 6. This will secure the skis 40,42 together and define a large loop 50 at the other end of the carrier. Then both ski poles 52,54 are then placed together so that both handles 56,58 and both baskets (not shown in FIGS. 5–7) are touching. The handles 56,58 are placed through the large loop 50 that was previously defined in cord 12, and the lock 16 which is nearest the poles 52,54 is depressed and moved along cord 12 tight against the poles 52,54 as shown in FIG. 7. The foregoing procedure is repeated using a second, identical carrier at the opposite ends of the skis and poles. The coatings 26 and 28 protect the cord 12 from the sharp edges of the skis and increase the friction of each of the smaller loops 18 and 20 against the skis and the poles so that each of the smaller loops does not slip down the skis or poles once the smaller loop has been tightened.

When removing the carrier assemblies 10 from the skis and poles, the assembly adjacent the straight ends of the skis and sharp ends of the poles preferably should be removed first, followed by removal of the assembly adjacent the curved ski ends and pole handles. Then both carrier assemblies can be folded up and conveniently carried in the skier's pocket until they are again attached to the skis and poles.

Figure 8:
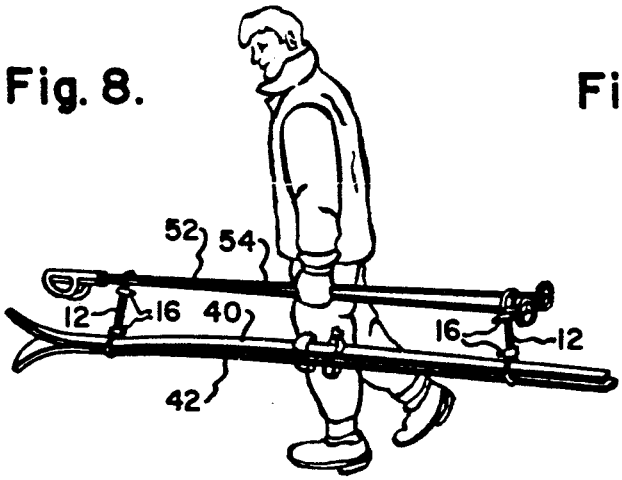
FIG. 8 is a perspective view illustrating the manner in which the carrier is used to carry skis horizontally, using the poles as handles.
Figure 9:
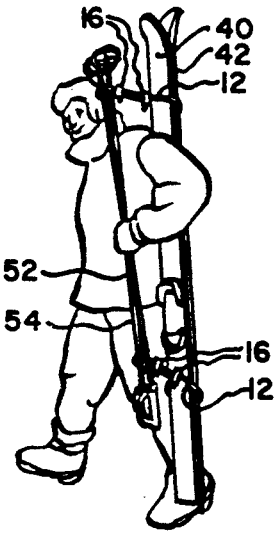
FIG. 9 is a perspective view illustrating the manner in which the carrier is used to carry skis vertically, by inserting one's shoulder and arm between the poles and skis.

FIGS. 8 and 9 illustrate the manner in which the carrier of the present invention is used. The skis 40,42 and the poles 52,54 may be carried in either a horizontal position like a suitcase using the poles as handles as shown in FIG. 8 or in a vertical position by placing one's arm through the space between the skis and the poles and holding the poles as shown in FIG. 9.

The carrier of the present invention may also be used to hang both the skis and the poles together when they are being stored and not in use. The assembly 10 at the top of the skis and poles has enough room between the skis and poles to hang them from a peg or hook so that they are kept neatly out of the way.

Advantageously, when the skis and poles are in use the pair of assemblies 10 may be kept in the skier's pocket until the skier is finished skiing and then easily put back onto the poles and skis wherever or whenever the skier wants.

It is therefore apparent that the present invention accomplishes its intended objects. While an embodiment of the present invention has been described in detail, that is for the purpose of illustration, not limitation.

What is claimed is:

1. A carrier assembly for hand carrying a pair of skis and poles substantially horizontally or vertically, which may be used as a hanger for storing the skis and poles, said carrier assembly comprising:

a) a pair of assemblies each comprising a flexible cord material formed into a continuous elongated large loop and having opposite ends; and b) each assembly including two cord locks which are placed between the ends of the assembly by inserting the large loop through each cord lock to form two smaller loops on either side of the locks;

c) each of said cord locks comprises a housing carrying a manually operated member which co-operate in a manner such that when the member is pressed, the cord lock moves freely along the large loop from end-to-end and when the member is released, the cord lock tightens against the large loop in a manner preventing relative movement between the cord lock and the large loop;

d) so that one of the smaller loops can be tightened with a lock against the pair of skis and the other smaller loop can be tightened with a lock against the pair of poles.

2. The carrier assembly of claim 1 wherein each of the smaller loops includes a portion of a rubber/plastic material to protect the cord from the sharp edges of the skis and to increase the friction of each of the smaller loops against the skis and the poles so that each of the smaller loops does not slip down the skis or the poles once the smaller loop has been tightened.

3. The carrier assembly of claim 1, wherein the cord is made of nylon thereby making it flexible enough to be placed easily in a pocket.

4. The carrier assembly of claim 1, wherein said elongated large loop is of a length to provide enough room between the skis and the poles so that one's arm may be placed between the skis and the poles so as to carry the weight of the skis and the poles on one's shoulder in a vertical position and also allows them to hang from a peg or hook when not in use.

5. A carrier for skis and poles which uses the poles as handles while hand carrying them in either a substantially horizontal position or a substantially vertical position with one's hand and shoulder between the poles and the skis, said carrier also usable to hang both the poles and skis for storage when they are not being used, said carrier comprising two identical parts each of which includes flexible cord and two manually operated cord locks, said flexible cord being inserted through said cord locks and each of said cord locks comprising a housing carrying a manually operated member which co-operate in a manner such that when the member is pressed, the cord lock moves freely along the cord and when the member is released, the cord lock tightens against the cord to prevent relative movement between the cord lock and the cord, said cord on each part forming two loops, one of said loops being tightened with a lock against the skis and the other loop being tightened with a lock against the poles, one of said parts being attached to the upper portion of the skis and poles, while the other of said parts will attach to the bottom portion of the skis and poles.

6. The carrier as defined in claim 5, further including a protective coating on a portion of the length of each cord.

* * * * *